US007677569B2

(12) United States Patent
O'Hara

(10) Patent No.: US 7,677,569 B2
(45) Date of Patent: Mar. 16, 2010

(54) STOCK CAR RACING CARD GAME

(76) Inventor: Thomas A. O'Hara, 5254 Kingston Rd., Elbridge, NY (US) 13060

( * ) Notice: Subject to any disclaimer, the term of this patent is extended or adjusted under 35 U.S.C. 154(b) by 185 days.

(21) Appl. No.: 11/776,737

(22) Filed: Jul. 12, 2007

(65) Prior Publication Data

US 2008/0012227 A1 Jan. 17, 2008

Related U.S. Application Data

(60) Provisional application No. 60/807,135, filed on Jul. 12, 2006.

(51) Int. Cl.
*A63F 3/00* (2006.01)

(52) U.S. Cl. ..... 273/246; 273/292; 273/298; 273/236; 463/58; 463/59; 463/60

(58) Field of Classification Search ..... 273/246, 273/292, 298, 236; 463/58–60
See application file for complete search history.

(56) References Cited

U.S. PATENT DOCUMENTS 3,414,264 A * 12/1968 Schriber ..... 273/249
4,357,017 A * 11/1982 Schneider et al. ..... 273/246
4,550,917 A * 11/1985 Ferris et al. ..... 273/246
4,874,177 A * 10/1989 Girardin ..... 273/246
5,048,841 A * 9/1991 Manney et al. ..... 273/246
5,114,151 A * 5/1992 Bergerstock ..... 273/246
5,226,655 A * 7/1993 Rickabaugh ..... 273/246
5,282,630 A * 2/1994 Dupuis, Jr. ..... 273/252
5,308,078 A * 5/1994 Hatter ..... 273/246
5,322,293 A * 6/1994 Goyette ..... 273/246
5,350,178 A * 9/1994 Hollar ..... 273/246
5,551,698 A * 9/1996 Lyon ..... 273/246
5,551,699 A * 9/1996 Pavelich ..... 273/246
5,560,609 A * 10/1996 Grant ..... 273/246
5,749,582 A * 5/1998 Fritz et al. ..... 273/246
5,810,358 A * 9/1998 Manson ..... 273/251
5,934,673 A * 8/1999 Telarico et al. ..... 273/246
6,095,522 A * 8/2000 Spell et al. ..... 273/246
6,213,466 B1 * 4/2001 Rosen ..... 273/236
6,464,223 B2 * 10/2002 Rutter ..... 273/246
6,471,209 B1 * 10/2002 Barshinger ..... 273/246
6,764,076 B2 * 7/2004 Merritt ..... 273/246
6,834,856 B2 * 12/2004 Wilson ..... 273/246
6,979,000 B1 * 12/2005 Vahala ..... 273/246
7,118,108 B2 * 10/2006 Yu et al. ..... 273/248

(Continued)

OTHER PUBLICATIONS

John McLeod, "Rummy", Oct. 8, 2004, [Online] <www.pagat.com/rummy/rummy.html>, pp. 1-4.*

*Primary Examiner*—Gene Kim
*Assistant Examiner*—Alexander R Niconovich
(74) *Attorney, Agent, or Firm*—George R. McGuire; Bond Schoeneck & King, Pllc

(57) ABSTRACT

A card game simulative of automobile track racing comprises a deck of cards having several categories of cards, including lap cards, offensive pit cards, defensive pit cards, sponsor cards, and a draft card, a die for determining a track condition for each round of play, and a method for keeping score to determine the order of finish for each player. The rules of the game closely simulate auto track racing with each player utilizing the cards in a strategic manner based upon certain track conditions and that approximates the strategic decisions an actual auto track racer makes during a race.

8 Claims, 3 Drawing Sheets

U.S. PATENT DOCUMENTS

| | | | | |
|---|---|---|---|---|
| 7,261,296 | B1 * | 8/2007 | Duncan | 273/246 |
| 2002/0020964 | A1 * | 2/2002 | Rutter | 273/246 |
| 2003/0209855 | A1 * | 11/2003 | Wilson | 273/246 |
| 2003/0218301 | A1 * | 11/2003 | Gonzalez | 273/248 |
| 2004/0222589 | A1 * | 11/2004 | Taylor | 273/246 |
| 2004/0232615 | A1 * | 11/2004 | Thompson et al. | 273/259 |
| 2005/0006843 | A1 * | 1/2005 | Yu et al. | 273/249 |
| 2005/0077675 | A1 * | 4/2005 | Gaylor | 273/146 |

* cited by examiner

RACETIME-SCORE SHEET

| Points | RACER #1 | RACER #2 | RACER #3 | RACER #4 | RACER #5 |
|---|---|---|---|---|---|
| First Place + 90 | | | | | |
| Second Place + 70 | | | | | |
| Third Place + 50 | | | | | |
| Fourth Place + 30 | | | | | |
| Fifth Place + 10 | | | | | |
| | | | | | |
| Bonus Points | | | | | |
| Checkered Flag + 50 | | | | | |
| Half-way Leader + 25 | | | | | |
| 180 Plays + 25 | | | | | |
| 360 Plays + 50 | | | | | |
| The 0 Factor + 50 single | | | | | |
| The 0 Factor + 100 double | | | | | |
| Perfect Race (all 100s) + 100 | | | | | |
| 1/2 Perfect Race (all 50s) + 50 | | | | | |
| White Flag Call + 50 | | | | | |
| Fourth Turn Finish + 100 | | | | | |
| | | | | | |
| Penalties | | | | | |
| Draft Cards (not played) -50 | | | | | |
| | | | | | |
| RACE TOTAL | | | | | |

Bonus Points – explanation

Checkered Flag – First person to put down exactly 500 laps receives 50 bonus points Half-way–First person to exceed 250 laps receives 25 bonus points 180 Plays–sponsor card or pace car played at any time as a defensive play receives 25 bonus points 360 Plays–sponsor card or pace car played in response to an offensive pit card move by another racer receives 50 bonus points The 0 Factor (single)–sponsor or pace car drawn and played on your turn when under a single offensive pit receives 50 bonus points The 0 Factor (double)–sponsor or pace car drawn and played on your turn when under a double offensive pit receives 100 bonus points Perfect Race=the use of all five 100 lap cards in building your lap tower to reach 500 laps receives 100 bonus points 1/2 Perfect Race=the use of all five 50 lap cards in building your lap tower to reach 500 laps receives 50 bonus points White Flag Call–racer who declare that he is going to reach 500 laps one more time past the flagman earns 50 bonus points if he does reach 500 laps in his next turn Fourth Turn Finish–a racer who uses his draft card to take the previous racer's laps to complete 500 laps earns 100 bonus points Penalty–explanation Draft card still in racer's hand when 500 laps are completed–deduct 50 points for each

FIG.3

STOCK CAR RACING CARD GAME

CLAIM OF PRIORITY

The present application claims priority to U.S. Provisional Patent Application Ser. No. 60/807,135, filed Jul. 12, 2006, the entirety of which is hereby incorporated by reference.

BACKGROUND OF THE INVENTION

The present invention relates generally to games simulating auto racing, and more particularly to a card game that simulates stock car track racing.

Automobile racing around a track has become a popular spectator sport. The National Association for Stock Car Auto Racing, Inc. (NASCAR), which began in 1948, is the sanctioning body for auto track racing in the United States. Under its guidance, NASCAR® racing has become the United States' top spectator sport—holding 17 of the top 20 attended sporting events in the U.S. in recent years, the second rated regular-season sport on television with broadcasts in over 150 countries, and has around 75 million fans that purchase over $2 billion annually in licensed products.

NASCAR racing consists of three major national series (NASCAR NEXTEL Cup Series, NASCAR Busch Series and the NASCAR Craftsman Truck Series) as well as eight regional series and one local grassroots series. NASCAR sanctions 1,500 races at over 100 tracks in 35 U.S. States, Canada and Mexico. Thus, in addition to individual races, the sport that is guided by NASCAR also has a series format wherein the racers collect points at each race and a winner is ultimately determined by which racer has the most points collected at the end of the series.

The fans of NASCAR, as described supra, desire merchandise that is associated with auto racing, including clothing, toys, posters, and other general merchandise. In order to simulate the sport without having to actually play the sport it is desirable that the fans be provided with games having strategies that closely approximate the sport itself.

It is therefore a principal object and advantage of the present invention to provide a game that simulates the sport of auto track racing.

It is another object and advantage of the present invention to provide a game that can be played in one sitting, or played as a series event wherein points are collected over a series of games.

It is a further object and advantage of the present invention to provide a game that is portable.

It is still another object and advantage of the present invention to provide a game that may be inexpensively manufactured.

Other objects and advantages of the present invention will in part be obvious, and in part appear hereinafter.

SUMMARY OF THE INVENTION

In accordance with the foregoing objects and advantages, the present invention provides a game simulative of auto track racing, comprising a physical deck of cards, each card being categorized into one of a plurality of card types comprising lap cards each of which contains a number of laps printed thereon, condition cards each of which contains a condition printed thereon, and repair cards each of which contains a repaired condition printed thereon; a die, or other chance determining means, for determining the track condition; and a play area comprising a common discard pile area, a common draw/play pile area, a plurality of player lap piles, and a plurality of player condition piles. The play area may be defined on a game board having designated spaces for the various piles of cards, or can simply be a make-shift area defined in the space on which the game is being played, without any formal game structure being provided (e.g., on a table around which the players are seated.)

The method for playing the game simulative of automobile track racing, generally comprises the steps of providing a physical deck of cards, each card being categorized into one of a plurality of card types comprising lap cards each of which contains a number of laps printed thereon, condition cards each of which contains a condition printed thereon, and repair cards each of which contains a repaired condition printed thereon; dealing a predetermined number of cards into a predetermined number of piles of cards, the predetermined number of piles corresponding to the number of players playing the game, and placing the non-dealt cards in a draw/play pile; designating one of the players as the flagman; providing a die containing a plurality of sides with each side containing identifying means for determining the track condition, wherein the flagman will roll the die to determine the first track condition; providing that each player shall have a lap pile and a condition pile, and that the draw/play pile and a discard pile shall be positioned in a common play area; each player taking a turn in sequence playing the game, wherein each player's turn comprises the steps of drawing a card from the draw/play pile, and discarding a card from his/her pile of cards into one of the following piles: his/her lap pile, his/her condition pile, and the condition pile that is associated with another of the players; after each player has taken a turn in sequence, the step of the flagman rolling the die to determine a subsequent track condition; and continuing the sequential playing of the game until an end of game condition is satisfied. An end of game condition can include, for example, the first player to accumulate a predetermined number of laps, e.g., exactly 500 laps, in his/her lap pile (although any number of laps could be designated as constituting a complete game/race), or the aggregation of the most points by any player collected over a series of individual games/races.

BRIEF DESCRIPTION OF THE DRAWINGS

The present invention will be more fully understood and appreciated by reading the following Detailed Description in conjunction with the accompanying drawings, in which:

FIG. 3 is a plan view of a representative score card used in playing the game according to the present invention.

DETAILED DESCRIPTION

Figure 1:
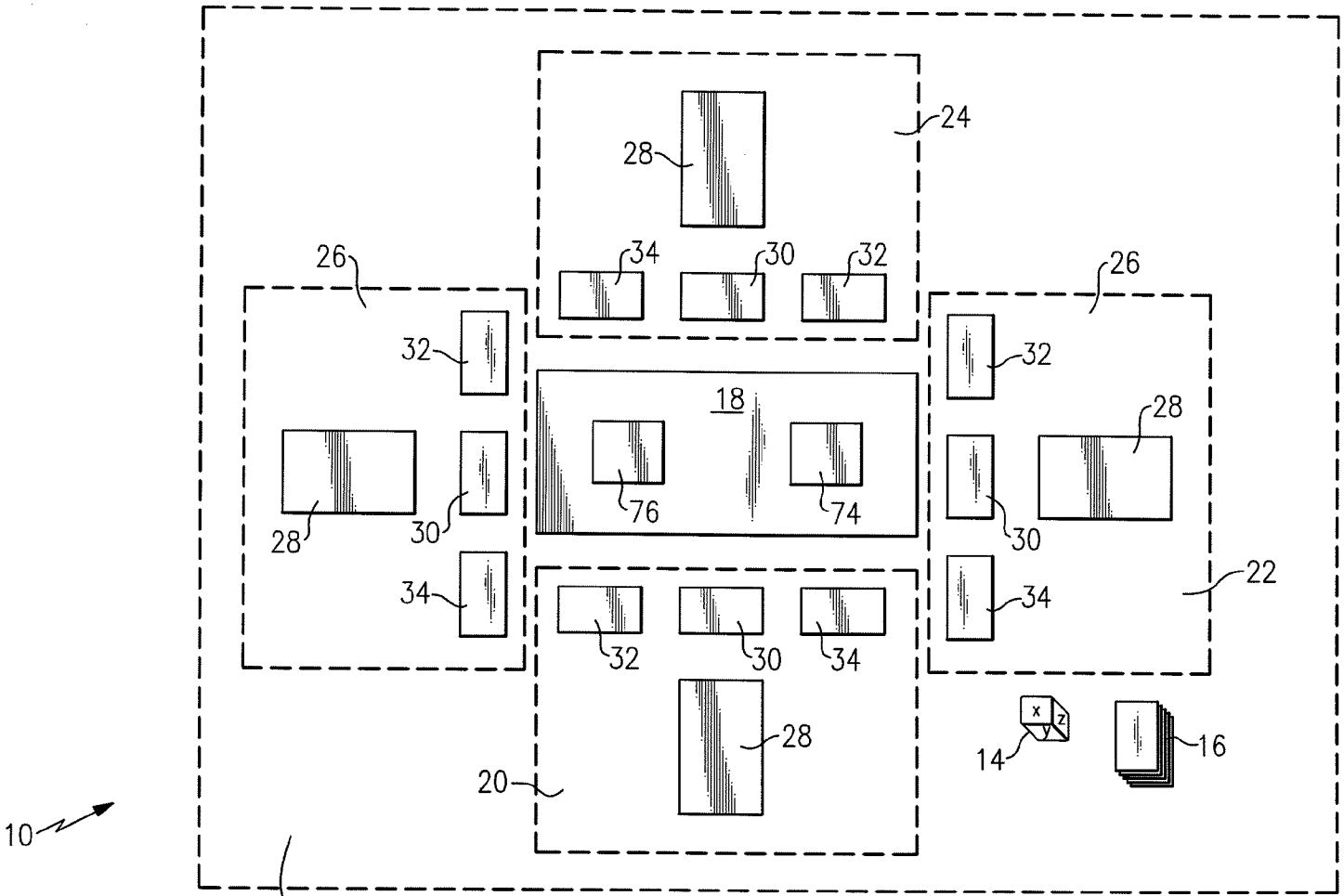
FIG. 1 is a representational schematic view of a game layout according to the present invention.

Referring now to the drawings, in which like reference numerals refer to like parts throughout, there is seen in FIG. 1 a game that simulates auto track racing, designated generally by reference numeral 10. Game 10 generally comprises a play area 12, a die 14, and a physical deck of cards 16.

Play area 12 consists of either a board layout or simply a make shift area on a table or other surface on which the game is being played, and includes a common play area 18, and player stations 20 (player 1), 22 (player 2), 24 (player 3), and 26 (player 4) (although it should be noted that the game can be played by two or more players with FIG. 1 simply illustrating the game set up for four players). Each player station 20-26 includes a lap pile area 28, a condition pile area 30, and two special card pile areas 32 and 34 (pile area 32 being referred to hereinafter as the "180° play area" and pile area 34 being referred to hereinafter as the "360° play area").

Die 14 can be a standard six sided die, or other multi-faceted die, with each surface being representative of a track condition. There are three different track conditions possible; a green flag condition, a yellow flag condition, and a red flag condition, the consequences of which will be explained hereinafter. Of course, other "chance" tools could be used, such as, for example, a spinner which could be spun instead of rolling the die, or chance cards which could be drawn or selected instead of rolling the die.

Figure 2:
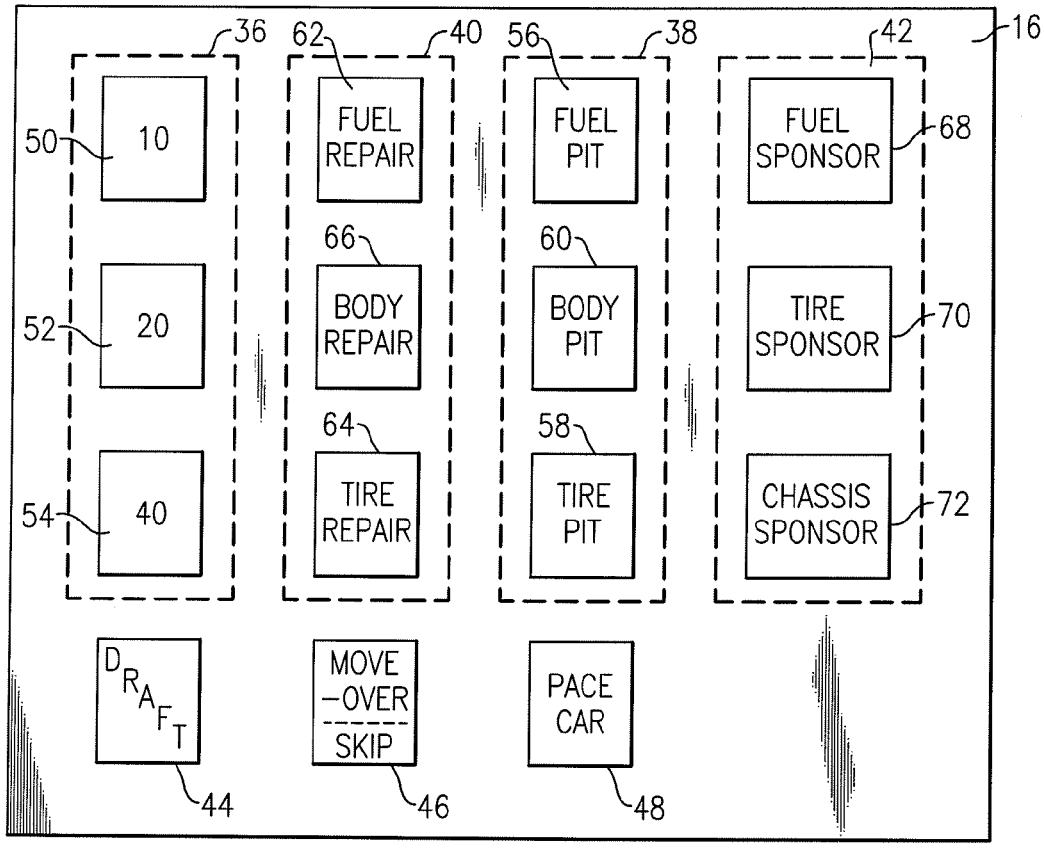
FIG. 2 is a plan view of representative cards used in playing the game according to the present invention.

Deck of cards 16 includes several different categories of cards as illustrated in FIG. 2. Amongst the categories of cards are: lap cards 36, defensive condition/pit cards 38, offensive condition/pit cards 40, sponsor cards 42, draft cards 44, a "move-over/skip" card 46, and a pace car card 48. Amongst each category of cards, there are specific cards. For instance, inclusive amongst lap cards 36 are a predetermined number of first valued e.g., 10 laps, lap cards (representative of 10 laps) 50, a predetermined number of second value e.g., 20 laps, lap cards (representative of 20 laps) 52, a predetermined number of third value e.g., 40 laps, lap cards (representative of 40 laps) 54 (although these are the only demarcations illustrated, it is understood that any other demarcations are possible, including for example 60, 80, 50, and 100 lap cards). In the invention's preferred mode, there are 10 each of the 10, 20, 40, 60, and 80 valued lap cards, and 5 each of the 50 and 100 valued lap cards.

With regard to offensive pit cards 38, there are fuel cards 56 (preferably 3 one tank cards and one two tank cards), tire cards 58 (preferably 3 one-sided tire change cards and one two-sided tire change card), and body damage cards 60 (preferably 3 one-sided body damage card, and one two-sided body damage card). The fuel cards 56 may be played against an opponent (by placing on the opponent's condition pile 30) during a player's turn, if the track conditions permit as described hereinafter, which places that opponent in the pits for a turn (thereby losing the opportunity for that player to play lap cards 36 until such time as that person can get out of the pits by playing a corresponding defensive pit card 40 as described hereinafter.) A "two tank" fuel card will require the opponent to use two corresponding defensive fuel cards to get out of the pit. The same rules apply for playing the body damage and tire cards 60 and 58 (i.e., the opponent remains in the pit until such time as that opponent can get out of the pit by playing corresponding defensive pit cards 40.)

With regard to defensive pit cards 40, there are fuel repair cards 62 (12 one tank cards provided in the preferred mode), tire repair cards 64 (12 one-sided change cards in preferred mode), and body damage repair cards 66 (12 one-sided repair cards in the preferred mode). Thus, if an opponent places you in the pit for a two-sided body damage repair, it will require playing two of the one-sided body repair cards 66 (by placing these cards on your own condition pile 30 during your turn) to get out of the pit and resume play. The same rules apply for tire and fuel changes.

Another way for a player to get out of a pit condition brought on by another player placing you in a pit by playing an offensive pit card 38 is for the affected player to have and play a corresponding sponsor card 42. Sponsor cards comprise a fuel sponsor card 68, a tire sponsor card 70, and a chassis (or body) sponsor card 72. In the preferred mode, only one each of these sponsor cards are provided. If one player is placed in the pit by an opponent placing an offensive pit card 38 in the condition pile 30, the affected player can play a corresponding sponsor card in one of two ways. First, if a player is not in the pit condition, he/she can place the card in the 180° play area 32 during that player's turn and then that player cannot be sent to the pits for the stated condition (fuel, tire or body) for the remainder of that round (i.e., if playing the fuel sponsor card 68, you cannot be sent to the pits for a fuel change during that round of play). In addition, the player is awarded 50 points for playing the sponsor card in the 180° play area 32 (the effects of points will be described hereinafter). Second, the player can place the card in the 360° play area 34 immediately after being sent to the pits by an opponent which will automatically bring the turn to that player who will then remove the offensive pit card 38 and place it in the discard pile 74 in the common play area 18, will draw one card from the draw/play pile 76 in the common play area 18 to replace the sponsor card 42, will draw another card from the draw/play pile 74 for that player's actual turn, and return to normal play. By playing the sponsor card 42 in the 360° play area 34, the player will be awarded 100 points. As an alternative to playing the sponsor card 42 in the 360° play area 34, the player could also play the pace car card 48 to obtain the same results (although the pace car card will not result in the award of 100 points). In addition to the sponsor cards, there is another special card referred to as the pace car card 48 which is the corresponding offensive special card to the draft card 44. The pace car card 48 can be played as a 180 play or a 360 play as described above.

The draft cards 44 may only be played on the immediately preceding player (i.e., the player seated to the left), and who may not be in a pit condition at the time the draft card is played (e.g., it is not possible to draft a car that is not moving). Likewise, a player cannot play a draft card if that player is in a pit condition. If playing a draft card 44 it is to be placed on the opponent's condition pile 30 which provides notice to that player he/she is being drafted. The consequence of drafting and being drafted is that the last lap card 36 that was placed on the draftee's lap pile 28 will be removed and placed on the drafter's lap pile 28. Draft cards 44 may not be discarded at any time, and must be played or held in the player's hand until the first person reaches the predetermined number of laps that ends the game at which time the number of draft cards 44 remaining in the hand will be counted and a penalty assessed against that player, as described hereinafter.

The skip/move-over card 46 may only be played against the next successive player (i.e., the player seated to the right) who is not in a pit condition. The consequence of this play will result in the player against whom the skip/move-over card 46 has been played losing a turn.

There are three track conditions determined by the roll of the die 14: green flag conditions, yellow flag conditions, and red flag conditions. During a green flag condition, players are able to put down lap cards 36 of any denomination, can use draft cards 44 to draft another player that are not in a pit condition, send other drivers into a pit condition by playing an offensive card 38, make pit repairs by playing a defensive condition card 40, or simply discard into discard pile 72. During a yellow flag condition, players may put down lap cards 36 of up to only a predetermined number of laps (e.g., 40 laps maximum), may make pit repairs by playing a defensive condition card 40, send other drivers into a pit condition by playing an offensive card 38, or discard into discard pile 72. During a red flag condition, players may only send other drivers into a pit condition by playing an offensive card 38, or discard into discard pile 72. It should be noted that sponsor cards 42 and pace car card 48 can be played at any time.

In addition to the three track conditions determined by die 14, two other "flag" conditions can arise. One is referred to as a black flag which occurs when one player makes a disallowed play and is caught by another player (e.g., laying down 100 laps when a yellow flag condition exists, wherein only 40 laps maximum may be played, or if a defensive body repair card 66 is played but the player is in the pits for a fuel repair). The incorrectly played card will be placed in the discard pile 72, and the player will not get to redo his/her turn.

A white flag condition arises when a player calls this condition on the basis of his/her belief that they will reach the predetermined number of laps (i.e., 500 laps) in the next round of play (i.e., after play continues past the flagman one more time). If the player succeeds, he/she receives 50 bonus points, as will be described more hereinafter. A white flag condition may only be called once during a game.

To play the game 10, the dealer ("flagman") will shuffle the cards and deal 5 cards into a number of piles that corresponds with the number of players playing the game (i.e., if four players are playing, the flagman will deal 5 cards into 4 piles). The order of play will be counter clockwise (as like in auto racing where drivers drive counter clockwise around a track). The person to the right of the flagman will therefore pick up one of the dealt piles first, and so on until all four players have their respective piles of five cards. The non-dealt cards will be placed face down in the draw/play pile 74. The game will begin under green flag conditions starting with the person to the right of the flagman until it comes back to the flagman again. Once the flagman plays his/her turn, he/she will then roll the die 14 to determine the track condition for the next round.

During each player's turn, he/she must draw one card from the draw/play pile 74, and then play one card: either a lap card 36 which will accumulate the stated number of laps for that player, an offensive condition/pit card 38 against another player to send that other player into the pits for the stated condition, a defensive condition/pit card 40 to get out of the pit for the next round, a sponsor card 42 (playing it in either the 180° or 360° play areas 32, 34 as described hereinabove), a draft card 44 against the player who played previously (to the left) to achieve the result stated hereinabove, the skip/move-over card 46 as described hereinabove, or the pace car card 48 as described hereinabove. Once the play returns to the flagman and the flagman plays his/her turn, he/she will then roll die 14 to determine the track condition for the next round of play.

To end the game, one player must exactly reach a predetermined number of laps. In the preferred mode of playing the game, the predetermined number of laps is 500. Once the game is complete, scoring is tabulated to determine the order of finish. In the preferred mode of playing the game, the scoring is done by counting the number of laps each player has completed at the time the checkered flag has come out, and subtract 50 laps for each draft card 44 left in the player's hand. The order of finish is then determined based on the race total points after all bonus points and penalties have been calculated. If all of the cards in the draw/play pile 74 have been played, the top card on each condition pile 30 is left in place and the remaining cards are shuffled by the flagman and placed in the draw/play pile 74, and play can then resume until one player reaches the 500 laps.

For purposes of calculating the race total, as is illustrated in FIG. 3, points are awarded as follows:

First place in terms of laps completed (+90 points), second place (+70 points), third place (+50 points), fourth place (+30 points), fifth place (+10 points); bonus points are awarded for: checkered flag (+50 points), half way leader (i.e., first player to accumulate 250 laps—if 500 laps constitutes completion) (+25 points), 180° plays (+25 points), 360° plays (+50 points), the O-factor (drawing a sponsor or pace car card and playing it when under a single offensive pit condition for a single O-factor, or playing it against a double offensive pit condition—double O-factor) (+50 points for single, +100 points for a double), a perfect race (completing all 500 laps using five 100 valued lap cards) (+100 points), half perfect race (completing all 500 laps using ten 50 valued lap cards) (+50 points), white flag call (+50 points), fourth turn finish (a player who uses his/her draft card 44 to take laps from previous player's laps in order to complete 500 laps) (+100 points). Penalties are assessed for draft cards not played after the first player completes 500 laps (−50 points for each draft card remaining in hand). The points are then totaled and the player with the most points wins, and so on. Points can be accrued over a series of games with the player with the most points at the conclusion of the series being declared the series winner.

What is claimed is:

1. A method for playing a game simulative of automobile track racing, comprising the steps of:

a. providing a physical deck of cards, each card being categorized into one of a plurality of card types comprising: a plurality of lap cards each of which contains a representative number of laps printed thereon, a plurality of condition cards each of which contains a representative condition printed thereon, and a plurality of repair cards each of which contains a representative repair condition printed thereon;

b. dealing a predetermined number of cards into a predetermined number of piles of cards, the predetermined number of piles corresponding to the number of players playing the game, and placing the non-dealt cards in a draw/play pile;

c. designating one of said players to determine track conditions;

d. providing a track condition determining means for identifying means for determining the track condition, wherein said track condition determining player will determine the first track condition;

e. providing that each player shall have a lap pile, and a condition pile, and that the draw/play pile and a discard pile shall be positioned in a common play area;

f. providing that each player shall have the ability to play a condition card against an opponent player by placing the condition card on the opponent's player's condition pile;

g. each player taking a turn in sequence playing the game, wherein each player's turn comprises the steps of drawing a card from said draw/play pile, and discarding a card from his/her pile of cards into one of the following piles: said player's lap pile, said player's condition pile, said discard pile and said condition pile that is associated with another of said players;

h. after each player has taken a turn in sequence, the step of said track condition determining player employing said track condition determining means to determine a subsequent track condition that will continue throughout each player's next turn; and i. continuing the sequential playing of the game until an end of game condition is satisfied.

2. The method for playing a game according to claim 1, wherein the step of providing a physical deck of cards wherein said plurality of card types further comprises at least one of the following card types: sponsor cards, draft cards, skip/move-over cards.

3. The method for playing a game according to claim 1, wherein said step of providing a track condition determining means comprises providing at least one of the following: a die, a spinner, and a plurality of track conditioning cards.

4. The method for playing a game according to claim 1, wherein any one of the following track conditions can be determined by the track condition determining means: a first track condition, a second track condition, and a third track condition.

5. The method for playing a game according to claim 1, wherein said end of game condition comprises the first of said players accumulating a predetermined number of laps by playing said laps cards having denominations that sum to said predetermined number.

6. The method for playing a game according to claim 1, comprising the further step of calculating scores for each player following said end of game condition.

7. The method for playing a game according to claim 6, wherein said step of calculating scores fore ach player comprises the steps of awarding points for any number of the following conditions: the accumulation of lap cards played, being the player with the most laps completed entering the final round of play, being the player with to complete one half of the predetermined number of laps that ends the game, drawing and playing a predetermined card in the same turn, and reaching said end of game condition in a predetermined manner.

8. The method for playing a game according to claim 7, wherein said step of calculating scores for each player comprises the step of subtracting points from each player based upon the number of predetermined cards remaining in each player's hand when said end of race condition has been satisfied.

* * * * *